US005078641A

United States Patent [19]

Chen

[11] Patent Number: 5,078,641

[45] Date of Patent: Jan. 7, 1992

[54] COMBINATION TOY VEHICLE AND SCREWDRIVER

[76] Inventor: Chen-Hsiung Chen, No. 349, Sec. 1, Chien Kang Rd., Tainan, Taiwan

[21] Appl. No.: 618,222

[22] Filed: Nov. 21, 1990

[51] Int. Cl.[5] ..... A63H 33/30

[52] U.S. Cl. ..... 446/86; 446/145

[58] Field of Search ..... 446/85, 86, 87, 93, 446/97, 144, 145

[56] References Cited

U.S. PATENT DOCUMENTS

| | | | |
|---|---|---|---|
| 3,528,193 | 9/1970 | Yamakawa | 446/86 |
| 3,713,246 | 1/1973 | Kilroy, Jr. | 446/86 |
| 3,859,749 | 1/1975 | Morin et al. | 446/145 |
| 4,057,886 | 11/1977 | Brass | 446/86 X |
| 4,582,500 | 4/1986 | Hanson et al. | 446/144 X |

FOREIGN PATENT DOCUMENTS

| | | | |
|---|---|---|---|
| 832046 | 4/1960 | United Kingdom | 446/145 |
| 2090756 | 7/1982 | United Kingdom | 446/145 |

OTHER PUBLICATIONS

"Playdrill", from Playthings Magazine, Jul. 1964, vol. 62, No. 7.

*Primary Examiner*—Robert A. Hafer
*Assistant Examiner*—Sam Rimell
*Attorney, Agent, or Firm*—Morton J. Rosenberg; David I. Klein

[57] ABSTRACT

A multi-function toy and in particular to one having a main control body which has a star shaped gear at its axle end that may be adapted with an appropriate bit to act as a cordless screw driver to loosen or tighten this invention. The star shaped gear can also act as a transmission set to drive wheels of a toy vehicle to move.

1 Claim, 5 Drawing Sheets

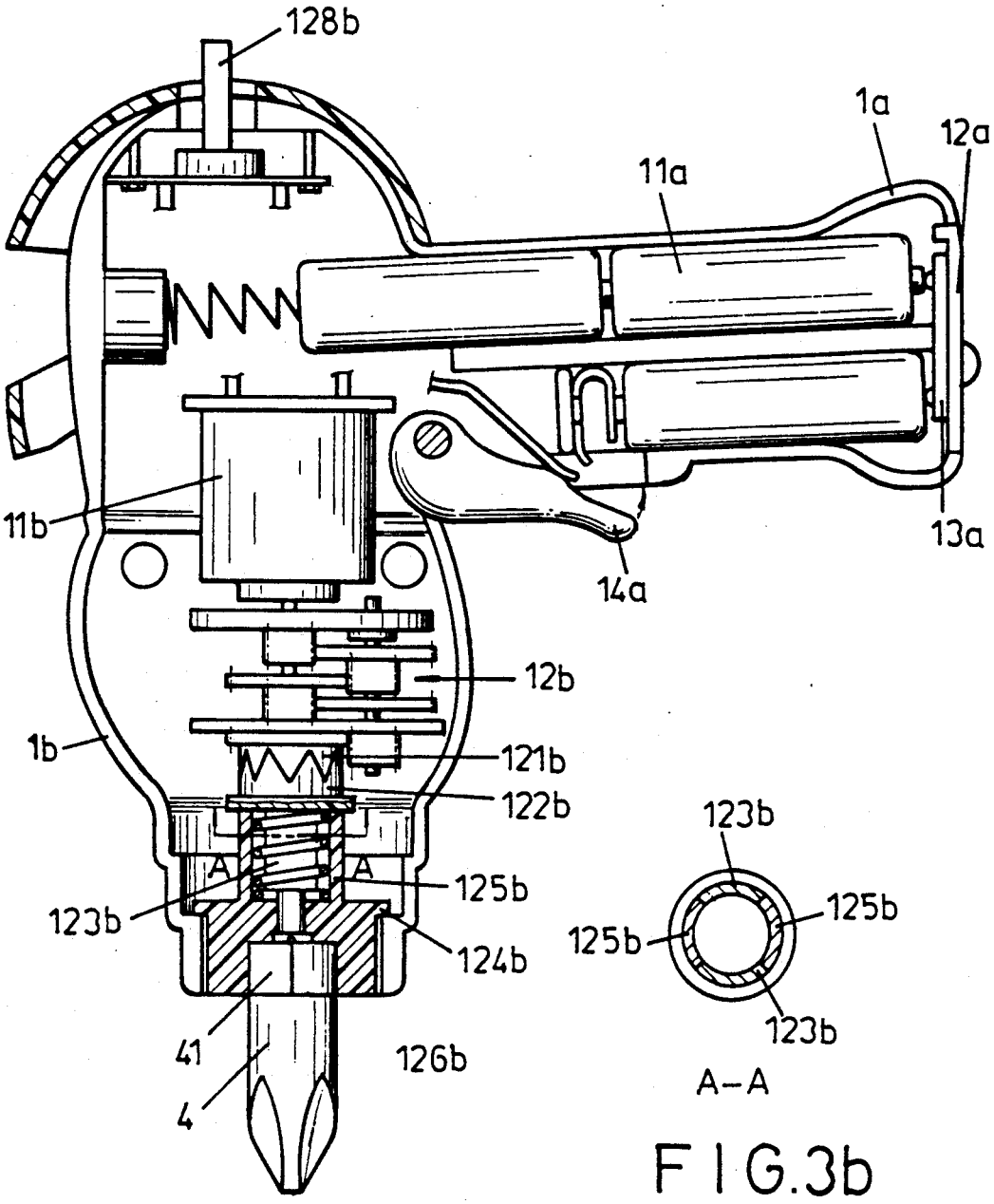
FIG.3a
FIG.3b
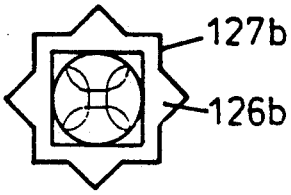
FIG.3c

COMBINATION TOY VEHICLE AND SCREWDRIVER

BACKGROUND OF THE INVENTION

The subject invention relates to a construction toy vehicle and a screwdriver combination. In particular, this invention relates to a combination type toy which may be taken apart and assembled by a user through use of an electrically operated screwdriver which may be mounted on one portion of the combination toy vehicle. The instant invention in particular directs itself to a main control body housing in the shape of a person which may be inserted into a second body housing in the overall contour of a vehicle such as an airplane. In particular, the main control body housing includes an actuation mechanism to drive the vehicle over a surface and further includes a mechanism wherein a screwdriver may be inserted and electrically driven to allow the user to take apart and assemble the overall combination toy. Still further, the combination toy vehicle of the subject invention is directed to a battery operated toy car or airplane in one mode of operation.

PRIOR ART

Prior art combination toy vehicles which are commercially available generally are found to vary in their overall appearance contour and do not provide for a multi-function toy vehicle which is used to provide entertainment and also to be an educational device where the user may assemble and disassemble the vehicle. In general, prior art toy vehicles cannot be reassembled when taken apart by users without appropriate tooling.

SUMMARY OF THE INVENTION

A combination toy vehicle and screwdrvier which includes a main control body housing having a control handle and a first body housing. The first body housing defines a body compartment containing a motor and a reduction gear mechanism for reducing the rotational speed of an output shaft of the motor. The first body housing has mounted thereon a three-way switch which is electrically coupled to the motor for controlling rotational direction of the motor output shaft. The control handle defines a battery compartment containing at least one battery and a trigger member for completing an electrical circuit between the battery and the motor. A second body housing having an upper shell and a lower shell in the form of a vehicle are threadedly securable each to the other. The upper shell has a vertically directed through opening for insert therein of the first body housing. The through opening is in open communication with a horizontally directed groove formed in the upper shell. A pair of recesses formed on opposing lateral walls of the upper shell are provided for insert of a pair of lug members formed on a canopy releasably secured to the upper shell and located at least partially in a covered manner over the first body housing. There is provided at least a pair of upper shell connecting posts threadedly securable to a pair of lower shell connecting posts formed on the lower shell. The lower shell has a lower shell groove for insert of a bearing stand. A transmission mechanism is provided for rotating a pair of wheels extending from opposing lateral sides of the lower shell. The transmission mechanism includes a bearing fixture mechanism for rotational actuation about a vertical axis responsive to the rotation of the motor output shaft. The bearing fixture mechanism has a pair of bevel gears in mating engagement for transforming rotation about the vertical axis to a rotation about a horizontal axis, wherein one of the bevel gears is fixedly secured to an axle of the wheels. A bit member is insertable into a lower section of the first body housing for providing the bit member to be rotated responsive to actuation of the motor and permit the first body housing to be utilized as an electrically driven screwdriver.

It is an object of the present invention to provide a multi-function toy which teaches the user the basic theory of transmission.

It is still another object of the present invention to provide a multi-function toy which may be used in one mode of operation as a battery operated toy car.

It is a further object of the present invention to provide a combination toy vehicle and screwdriver where the invention may be used as a battery operated toy vehicle and as an electrically operated screwdriver to assemble and disassemble the toy vehicle.

BRIEF DESCRIPTION OF THE DRAWINGS

FIG. 3A is a cross-sectional view of a main control body housing of the present invention showing installation of a screwdriver bit;

FIG. 3B is a cross-sectional view taken along the Section Lines A—A of FIG. 3A;

FIG. 3C is a cross-sectional view of a portion of the transmission drive of the subject invention;

DESCRIPTION OF THE PREFERRED EMBODIMENTS

Figure 1:
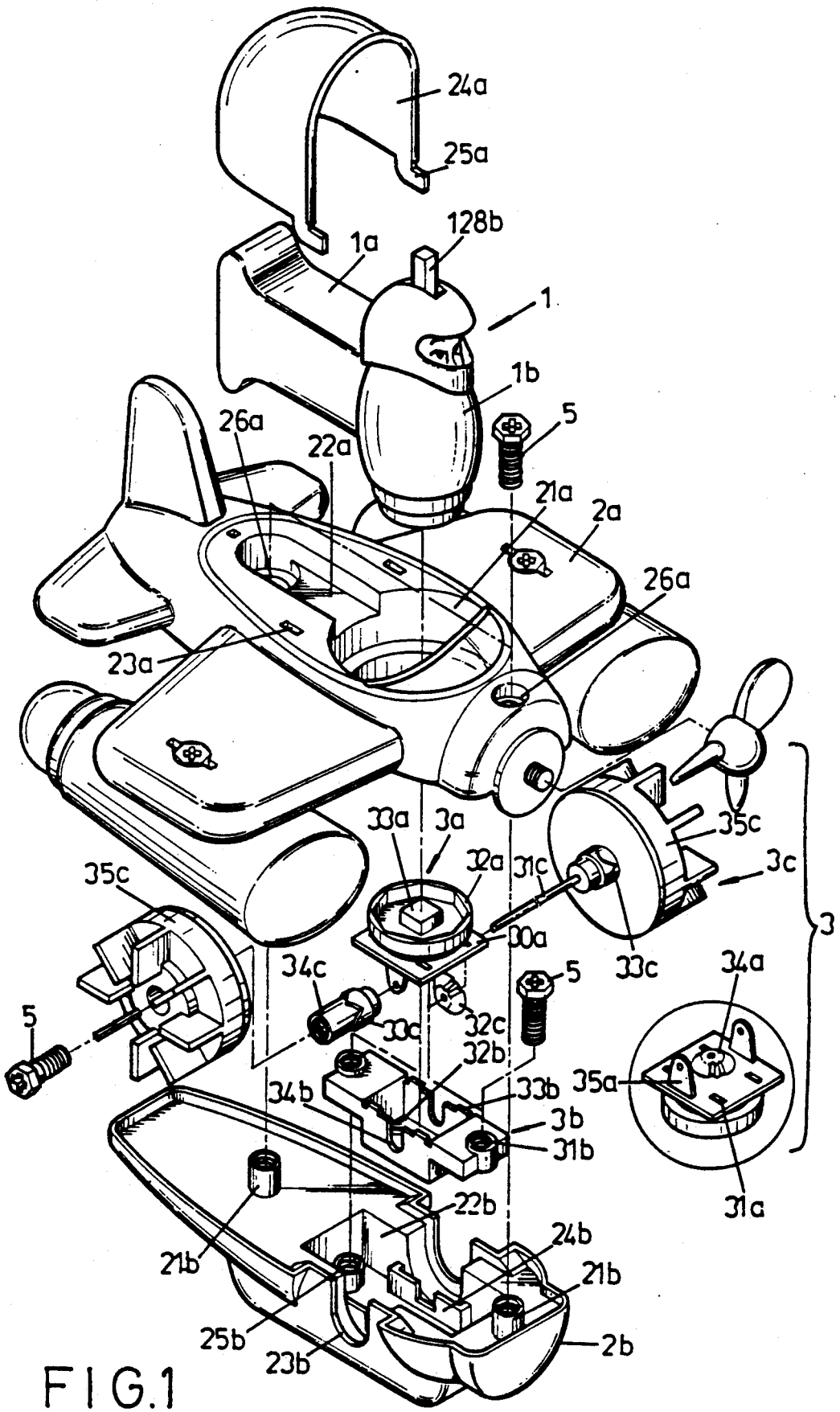
FIG. 1 is a blow-out perspective view of the subject combination toy vehicle and screwdriver.
Figure 2:
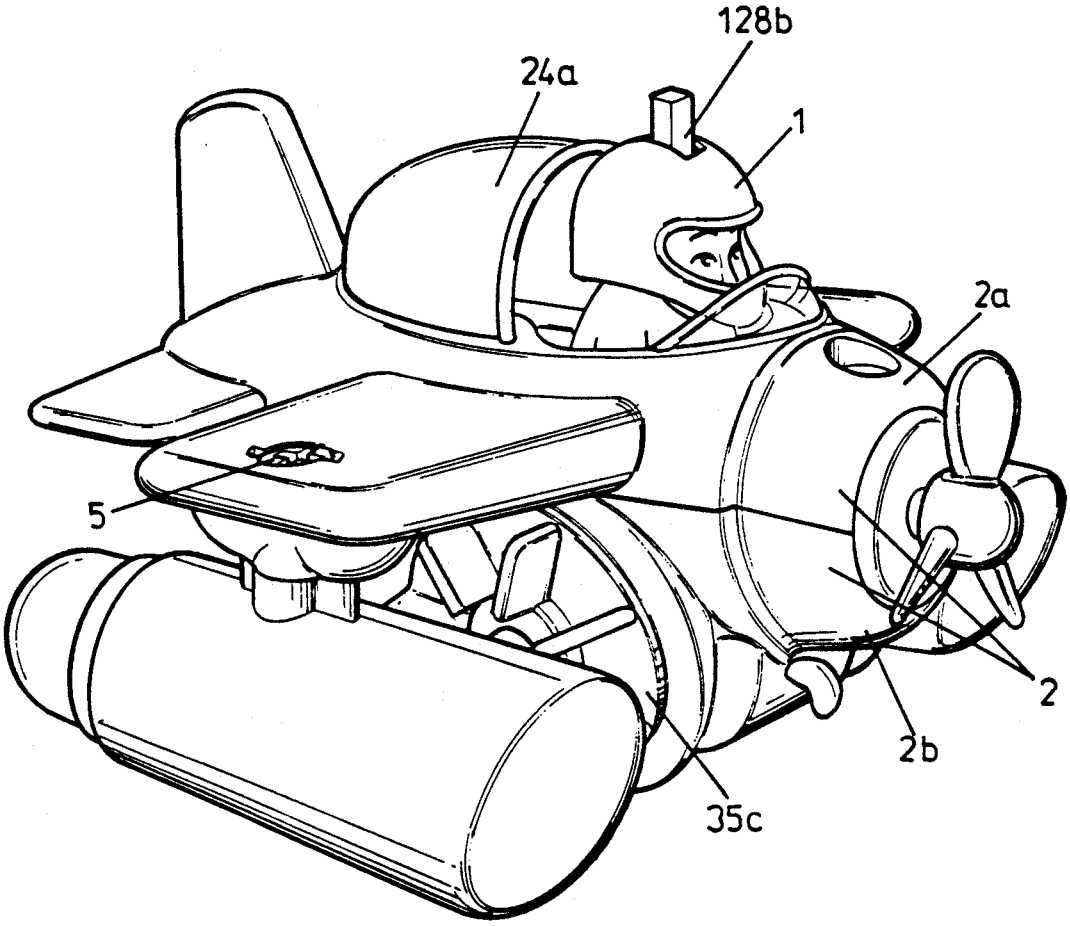
FIG. 2 is a prespective view of the combination toy vehicle in an assembled mode.
Figure 4:
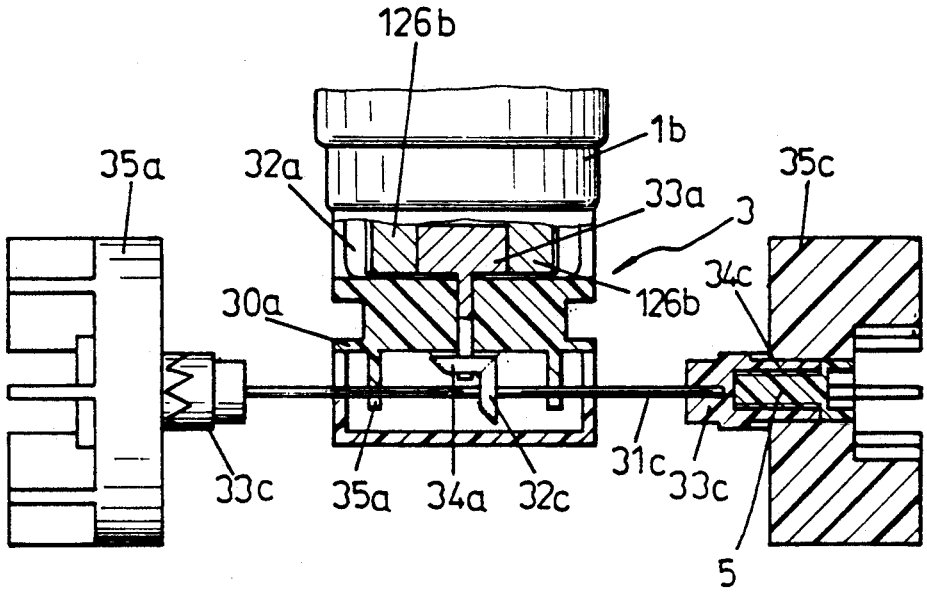
FIG. 4 is a cross-sectional view of the transmission mechanism of the subject invention shown in FIG. 1; and, FIG. 5 is a perspective view of the subject invention showing operation of the combination toy vehicle and screwdriver as an electrical screwdriver.
Figure 5:
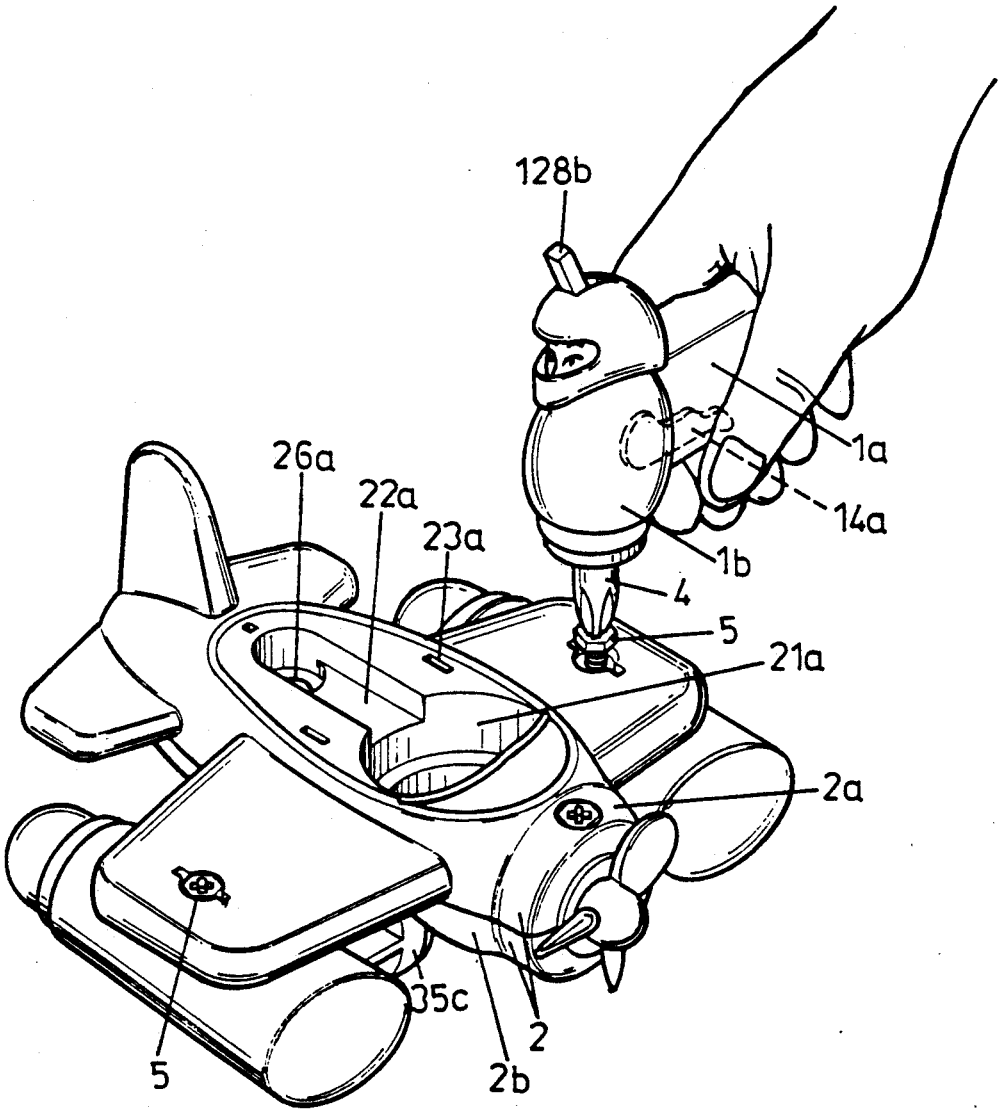

Referring now to FIGS. 1-5, there is shown the combination toy vehicle and electrically driven screwdriver of the subject concept. The combination toy vehicle and screwdriver includes main control body housing 1 in the overall contour of a caricature of a person, although this is merely exemplary in nature. Further included in the combination toy vehicle and screwdriver is second body housing 2 which is in the overall contour of a vehicle, which for purposes of example, is shown as an airplane. Second body housing 2 includes upper shell **2*a* and lower shell 2*b*, as is clearly shown in FIG. 1. Transmission mechanism 3 and screwdriver bit 4 are more clearly shown in FIGS. 3*a* and 5**.

Main control body 1 in the overall contour of a caricature of a person, includes handle member **1*a* and first body housing 1*b*. Handle 1*a* extends horizontally from first body housing 1*b* as shown in FIG. 3*a* and has a battery compartment 11*a* formed therein. Cap member 12*a* provides closure for battery compartment 11*a* and includes copper contacts 13*a* on the inner surface of cap 12*a*** to provide electrical contact.

Trigger member **14*a* is formed at the bottom section of handle 11*a* to provide actuation of motor 11*b* for actuation of the combination toy vehicle and screwdriver. Thus, first body housing 1b defines a body compartment containing motor 11b and further includes reduction gear mechanism 12b for reducing the rotational speed of the output shaft of motor 11b. It is seen in FIG. 3a that reduction gear mechanism 12b is coupled through upper gear 121b and lower gear 122b to provide rotational power. Lower gear 122b has a plurality of teeth 123b at a bottom section that couples with teeth members 125b of the circular plate 124b and is then coupled to the top of the star shaped groove 127b of the star shaped plate 126b**.

Referring to FIGS. 1 and 3a, the top of the first body housing 1b has a three-way switch 128b that is connected through a standard circuitboard to motor 11b, battery 11a, and trigger 14a to control the rotation of star shaped groove 127b in either a clockwise, counterclockwise or non-rotating condition.

Second body housing 2 includes upper shell 2a and lower shell 2b, as is shown in FIG. 1. Upper shell 2a has through opening 21a formed therethrough and includes groove 22a extending in a horizontal direction and in open communication with through opening 21a in order that main control body 1 may be inserted therein.

A pair of recesses 23a are formed on opposing lateral sides of upper shells 2a in order to allow canopy 24a having a pair of lugs 25a to be inserted into recesses 23a in order to positionally locate canopy 24a in a releasably constrained manner. Upper shell 2a further includes a pair of connecting posts 26a to connect lower shell 2b to upper shell 2a.

Lower shell 2b has a pair of connecting posts 21b that align with connecting posts 26a of upper shell 2a. A groove 22b is provided in lower shell 2b to accommodate and allow insertion therein of bearing stand 3b. A notch 23b accommodates bearing 31c, fixture mechanism 24b, and a pair of posts 25b to connect bearing stand 3b firmly within the groove 22b of lower shell 2b.

Transmission mechanism 3 includes bearing fixture mechanism 3a as well as the bearing stand 3b and a set of wheels 3c. Bearing fixture mechanism 3a has a circular stand 32a which is mounted on plate 30a that surrounds square post 33a which is used to be inserted into star shaped groove 127a. In this manner, the force transferred from motor 11b is used to drive bevel bearing 34a which is mounted beneath plate 30a. Four holes 31a at the four corners of plate 30a are shown and a pair of wheel lugs 35a are located beneath plate 30a. Bearing stand 3b is rectangular in overall contour and is mounted in the groove 22b which is substantially the same dimensions as the bearing stand 3b. A pair of threaded posts 31b located on opposing ends of bearing stand 3b are provided as well as a groove 32b with lugs 33b and a pair of notches 34b to allow passage therethrough of an axle of the wheels 35c.

The wheel components 3c include axle 31c as well as bevel gears 32c and 34a. A pair of barrel members 34c each having teeth 33c are inserted through a hole of an individual wheel 35c at one end and then fastened by screw members 5.

The screwdriver bit 4 is formed of a plastic material with a head 41 formed in a substantially square shape and may be inserted into the bottom portion of the star shaped groove 127b as shown in FIG. 3a.

In operational assembly, bearing 31c is inserted through wheel lugs 35a and crown gear 32c which is located between wheel lugs 35a. Transmission section 3 is then placed into groove 32b with the four holes 31a inserted into the four setting lugs 33b. Bearing stand 3b is placed into the groove 22b of the lower shell 2b. Using the main control body 1 to drive plastic screwdriver bit 4 through holes 31b into posts 25b and allows fastening bearing stand 3b and lower shelf 2b in a threadedly securable manner with screws 5. Upper and lower shelves 2a and 2b are aligned each to the other and mated and are then fastened with screws 5 through holes 26a in posts 21b. Screwdriver bit 4 is taken from main control body 1 and main control body 1 is inserted into second body housing 2 and allows star shaped gear 127a to be rotatably connected with square post 32a. Canopy 24a is mounted in position and when trigger 14a is displaced, motor 11b activates the transmission mechanism to provide rotational actuation to drive wheels 34c. When the user wishes to disassemble the combination toy vehicle and screwdriver, main control body 1 is removed from housing 2 and screwdriver bit 4 is installed to act as a screwdriver and allow the user the electrically unthread the screws of the subject assembly.

I claim:

1. A combination toy vehicle and screwdriver comprising:

a main control body housing having a control handle and a first body housing, said first body housing defining a body compartment containing a motor and reduction gear means for reducing the rotational speed of an output shaft of said motor, said first body housing having mounted thereon a three-way switch electrically coupled to said motor for controlling rotational direction of said motor output shaft, said control handle defining a battery compartment containing at least one battery and a trigger member for completing and electrical circuit between said battery and said motor;

a second body housing having an upper shell and a lower shell threadedly securable each to the other, said upper shell having a vertically directed through opening for insert therein of said first body housing, said through opening in open communication with a horizontally directed groove formed in said upper shell, a pair of recesses formed on opposing lateral walls of said upper shell for insert of a pair of lug members formed on a canopy releasably secured to said upper shell and located at least partially in covered manner over said first body housing, and including at least a pair of upper shell connecting posts threadedly securable to a pair of lower shell connecting posts formed on said lower shell, said lower shell having a lower shell groove for insert of a bearing stand;

transmission means for rotating a pair of wheels extending from opposing lateral sides of said lower shell, said transmission means including bearing fixture means for rotational actuation about a vertical axis responsive to rotation of said motor output shaft, said bearing fixture means having a pair of bevel gears in mating engagement for transforming rotation about said vertical axis to a rotation about a horizontal axis, one of said bevel gears fixedly secured to an axle of said wheels; and, a bit member insertable into a lower section of said first body housing for providing said bit member to be rotated responsive to actuation of said motor and permit said first body housing to be utilized as an electrically driven screwdriver.

* * * * *